United States Patent [19]

Mills et al.

[11] Patent Number: 4,515,275

[45] Date of Patent: May 7, 1985

[54] APPARATUS AND METHOD FOR PROCESSING FRUIT AND THE LIKE

[75] Inventors: George A. Mills; Gerald R. Richert, both of Three Rivers, Calif.

[73] Assignee: Pennwalt Corporation, Philadelphia, Pa.

[21] Appl. No.: 430,068

[22] Filed: Sep. 30, 1982

[51] Int. Cl.[3] ..... B07C 5/10; B07C 5/342

[52] U.S. Cl. ..... 209/558; 209/580; 209/586; 209/587; 356/394; 356/398; 358/106; 382/48

[58] Field of Search ..... 209/555, 556, 558, 580, 209/581, 582, 585, 586, 587; 356/394, 398; 358/106, 107; 250/562, 563; 382/48, 50

[56] References Cited

U.S. PATENT DOCUMENTS

| | | | |
|---|---|---|---|
| 3,835,332 | 9/1974 | Bridges | 250/563 |
| 3,868,636 | 2/1975 | Schlang | 382/48 X |
| 3,962,681 | 6/1976 | Requa et al. | 382/50 X |
| 4,106,628 | 8/1978 | Warkentin et al. | 209/556 |
| 4,189,235 | 2/1980 | Guter et al. | 356/239 |
| 4,207,593 | 6/1980 | Deutsch et al. | 358/106 |
| 4,246,098 | 1/1981 | Conway et al. | 209/558 |
| 4,281,933 | 8/1981 | Houston et al. | 209/582 X |
| 4,376,951 | 3/1983 | Miyazawa | 358/106 |
| 4,403,294 | 9/1983 | Hamada et al. | 358/106 X |

*Primary Examiner*—Robert B. Reeves
*Assistant Examiner*—Edward M. Wacyra

[57] ABSTRACT

Apparatus and method for processing fruit and the like, particularly for sorting as a function of variables including color, blemish, size and shape. The apparatus provides an illuminator for substantially uniformly illuminating a portion of the item being examined, and a signal detector array for generating a plurality of signals corresponding to respective different portions of the item being examined. The data signals corresponding to a given item are accumulated and then batch processed to determine sorting signals, while a next item is being examined and data signals for it are being accumulated. For blemish detection, the batch processing includes determination of differences between signals representing adjacent surface portions, and generation of blemish sorting signals as a function of such determined differences.

35 Claims, 8 Drawing Figures

APPARATUS AND METHOD FOR PROCESSING FRUIT AND THE LIKE

The present invention relates to apparatus and methods for processing fruit and similar items, and more particularly, apparatus for grading and sorting fruit and the like according to color, surface blemish, size and/or shape.

CROSS REFERENCE TO RELATED APPLICATION

This application discloses and claims different features of the same apparatus disclosed in co-pending application titled Apparatus For Spinning Fruit For Sorting Thereof, Ser. No. 430,083, filed Sept. 30, 1982, assigned to the same assignee and incorporated herein by reference.

BACKGROUND OF THE INVENTION

The field of processing fruit and vegetables and the like, particularly grading, sorting and packing, has become increasingly automated in recent years as labor costs have risen and processing problems have been identified. Systems and apparatus are known, for example, for sorting fruit and the like as a function of weight, color, or color and weight. See U.S. Pat. No. 4,106,628, assigned to the same assignee. Likewise, other devices have been disclosed in the patent literature for sorting items as a function of size, blemish, grade, and various combinations of the above factors. However, the equipment that is available to the industry remains limited in the functions that can be performed, and in the efficiency and reliability of the apparatus in performing those functions. For example, in much of the previously available equipment, sensors or detectors generate only a limited amount of data concerning one or more conditions of the item being processed, and the apparatus lacks capacity to process intelligently on the basis of relatively complete information. For the processing and sorting of fruit such as citrus, and particularly for sorting as a function of surface blemish of fruit, it is highly desirable to maximize the amount of information collected concerning the surface condition of the fruit and to efficiently utilize that data in making sorting decisions. However, to achieve these general objectives, it is necessary to provide improvements both in the area of transducers, or sensors for acquiring the information, and in the capacity of the apparatus to efficiently process the acquired information so as to make accurate sorting decisions. The present invention provides such improvements.

For apparatus sorting on the basis of blemish or culls, it becomes very important to substantially uniformly illuminate the object which is to be viewed, and to make substantially all surface portions of the item available for viewing. Further, in development of the apparatus of this invention, it has been determined that it is advantageous to have a system and method whereby the data representative of the surface condition of the item is batch analyzed, i.e. all of the data corresponding to the item is analyzed after it has been acquired, as compared to performing the analysis as the data is being serially acquired. In prior art devices where analysis is performed concurrently with data acquisition, assumptions must be made as to the nature of the data being received from each item, so as to permit data processing in accordance with some predetermined function. This procedure is basically inflexible, and prohibits programming so as to alter the data processing as a function of the received data.

In connection with this invention, it has been determined that greater flexibility and reliability of data processing of large amounts of data can be achieved by batch data processing of the data corresponding to each item, as opposed to the prior art mode of serial processing. Further, the provision of substantially uniform illumination of the fruit or other item being inspected, as well as means for moving the item relatively so that all portions thereof can be examined, enables more accurate and reliable determinations of characteristics such as color, blemish, size and shape.

SUMMARY OF THE INVENTION

It is an object of this invention to provide apparatus and a method for processing fruit or the like, particularly sorting of fruit for culls or blemishes utilizing improved illumination apparatus for uniformly illuminating the object so as to provide for generation of signals reliably representative of the surface of the fruit.

It is a further object of this invention to provide automated apparatus for examining successive items as they are passed through the apparatus, having means for obtaining a block of data corresponding to each examined item, and means for batch processing each such block of data to obtain sorting signals.

It is another object of this invention to provide an apparatus and method for blemish sorting of fruit and the like, by providing substantially constant uniform illumination of the object so as to obtain reliable signals representative of the surface condition of the item, and generating difference signals representative of the absolute difference of surface conditions for a plurality of adjacent surface portions of the item.

It is another object of this invention to provide apparatus for sorting citrus and the like as a function of color, volume and/or shape.

It is another object of this invention to provide sorting apparatus which is microcomputer controlled, and has improved processing capacity for reliable sorting of fruit at high speeds.

In accordance with the above objects, there is provided apparatus, and a method of operation, for generating a block of data signals corresponding to each item to be sorted, and means for batch analyzing the block of signals to generate desired sorting signals as a function of blemish, color, volume and/or shape. The apparatus includes an illumination system for providing substantially uniform illumination of the surface of the item as it is processed, and means for moving or rotating the item relative to the apparatus so that substantially all portions of the surface are examined. The apparatus further includes microcomputer controlled processing of data, preferably including determination of differences of data signals representing different surface portions of the item, so as to generate a signal corresponding to overall blemish. Color, volume and shape are determined by inspecting the data signals corresponding to a given item and determining which ones exceed a predetermined threshold, so as to enable generation of width, width squared and length signals.

BRIEF DESCRIPTION OF THE DRAWINGS

The invention will be more fully understood by reference to the drawings, in which.

DESCRIPTION OF THE PREFERRED EMBODIMENTS

Reference is made to co-pending application Ser. No. 430,083, filed Sept. 30, 1982, for a detailed description of the mechanical features. of the apparatus of this invention, the disclosure of which is incorporated herein by reference. The apparatus of this invention may also be used with the apparatus disclosed in U.S. Pat. No. 4,106,628, also incorporated herein by reference.

Figure 1:
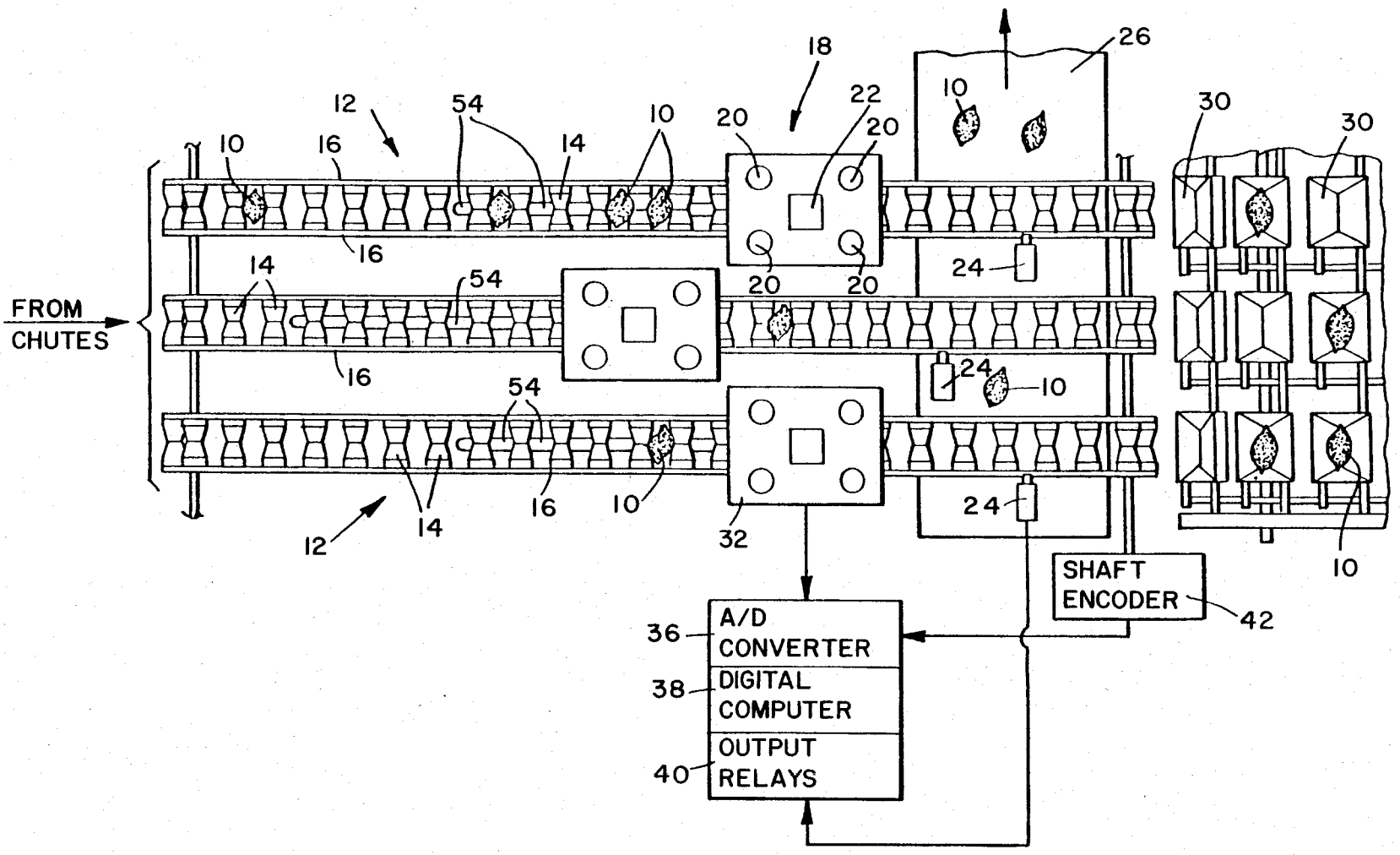
FIG. 1 is a schematic plan view of the apparatus of the present invention including a block diagram of components employed therewith.

Referring now to FIG. 1, items to be sorted or processed, typically fruit such as lemons illustrated at 10, but not limited thereto, are received from chutes (not shown) and deposited onto singulator conveyors 12 which place them in single file. In the illustration of FIG. 1, three such conveyors are shown, and there is illustrated a 3-lane apparatus. The apparatus described in the following specification applies equally to each lane, and it is to be understood that any number of lanes may be utilized, in accordance with the user's needs. Singulator conveyors 12 suitably comprise a plurality of spaced apart conveyor rollers 14 rotatably mounted on each side thereof to chains 16 which advance the fruit from left to right, as seen diagramatically in FIG. 1. The conveyor rollers contact and ride upon a passive spin track 54. The fruit is moved past a station where it is examined, and at which sorting means are provided for rotating the fruit as it is moved.

Each lane of the apparatus has a video system, or optical scanning unit 18. Each video system or optical scanning unit 18 is enclosed in a suitable housing 32 which housings are staggered to permit closer spacing of the singulator conveyors 12. Each video system 18 includes an illuminator subsystem and a detector subsystem. The illuminator subsystem comprises a plurality of illuminators 20 for uniformly illuminating the surface areas of the fruit being tested, processed or evaluated with suitable radiation such as visible, ultraviolet or infrared, depending upon the specific application. Four such sources or illuminators 20 are illustrated in FIG. 1 per video system 18 although different numbers of illuminators may be employed within the scope of this invention. The light reflected from the item 10 which is being moved relative to video system 18 is detected by a detector subsystem 22 or equivalent camera apparatus which generates video signals which are processed to determine a grade or feature signal or signals representative of features of the item to be sorted. The determined grade signals suitably control an ejector mechanism 24 on each lane, such as a solenoid or pneumatically activated device, for ejecting items onto a conveyor belt 26 for discharge. The remaining items may continue along the lane, to be categorized further in accordance with signals from detector subsystem 22, or additionally in accordance with other sorting signals, as shown and described in referenced U.S. Pat. No. 4,106,628. For example, the items may be electronically weighed after they have fallen into cups 30 downstream of singulators 12.

The video signals as generated by detector subsystem 22 are initially in analog form, and are digitized by an A/D converter shown at block 36. The digitized signals are fed into a digital computer unit or units, shown at block 38, for performing process evaluations of the fruit as are set forth in detail hereinbelow. For the preferred embodiment described herein, the processing is done as a function of surface blemish of the item, color, volume or shape, or combinations thereof. The signals generated by the processor units are connected to output relays 40, the outputs of which drive the ejector mechanism 24 as indicated. The shaft encoders 42 are employed for generating clocking signals to synchronize electronic positioning of the fruit and generation of the output signals from relay amplifiers 40. The shaft encoder signals are also used to control scanning of the detector subsystem 22.

Figure 2A:
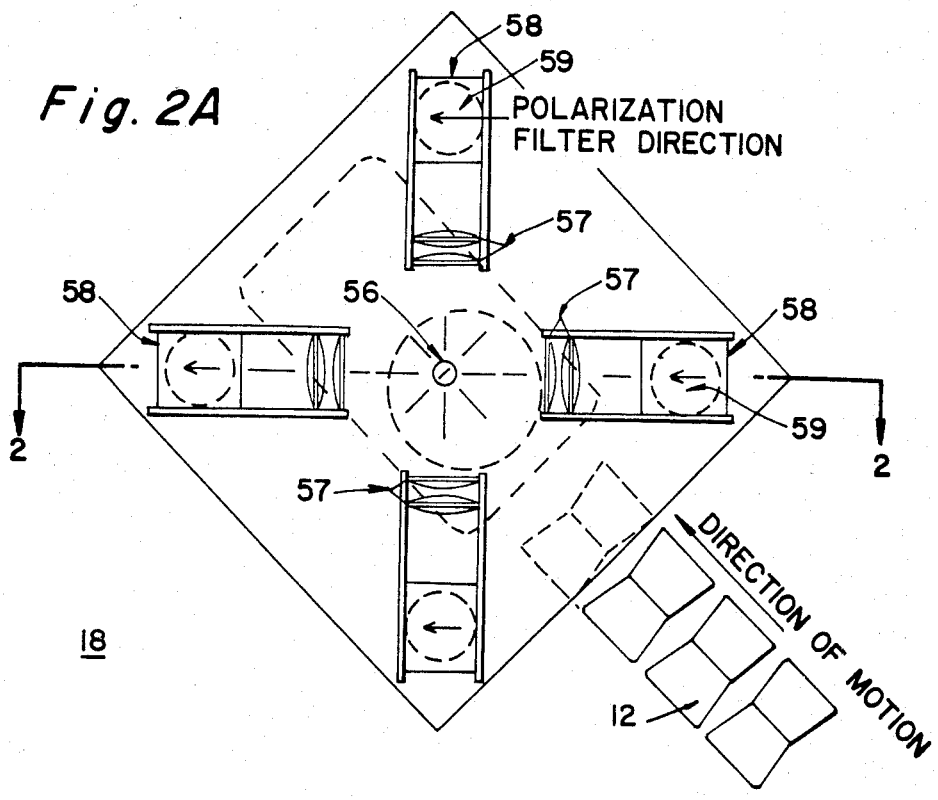
FIG. 2A is a top view of the video system of the present invention showing both the illumination subsystem and the detector subsystem.
Figure 2B:
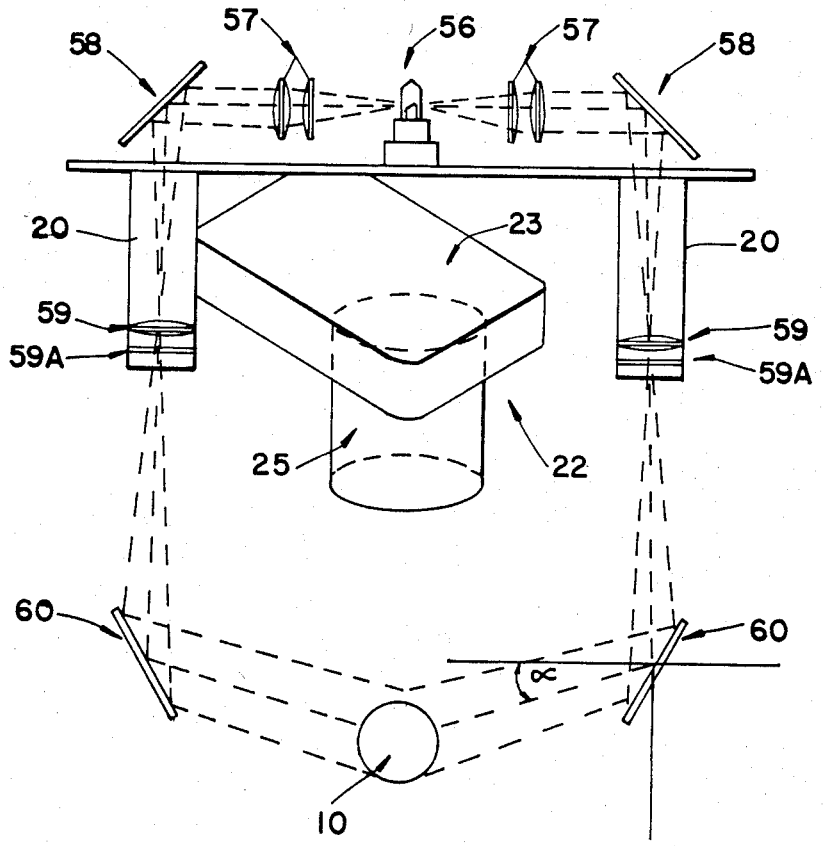
FIG. 2B is a cross sectional view of the video system of FIG. 2A taken along section lines 2—2.

Referring now to FIGS. 2A and 2B, there are shown schematic illustrations of the video system 18, as utilized in the apparatus of this invention. As seen in FIG. 2A, the video system 18 includes an illuminator subsystem comprising a lamp 56 which is used in common with a plurality of mirrors 58, to provide effectively four illuminators 20 or sources of light which are incident upon the passing fruit 10. Referring to FIG. 2B, light from lamp 56 passes through a condenser 57 and is reflected at substantially a right angle from first mirrors 58. The reflection from mirrors 58 is passed through a projection lens 59 and linear polarizing filter 59A (oriented as shown) to second mirrors 60, which are arranged at an angle to reflect light onto the fruit at a desired incident angle $\alpha$. The incident angle $\alpha$ is indicated as being measured from the horizontal, and is suitably in the range of 15°–45° and is preferably 24°. By placing four such light sources or illuminators 20 at approximately 90° with respect to the position where the fruit is examined, and maintaining the incident light from each source within the range of 15° to 45° from horizontal, it has been found that substantially uniform illumination of the fruit or item is achieved as viewed from above. Note that all four light sources 20 are directing their light onto the upper surface of the fruit at any given time, such that there is overlapping of the light that falls on different portions of the fruit from the different sources. Note also that due to the angle by which the light is directed onto the fruit, the edges, as seen by the detector subsystem 22 are illuminated uniformly along with other surface areas. Thus, at any given time that signals are being generated by the detector subsystem 22, the fruit portions being viewed are substantially uniformly illuminated. The fruit is rotated as it is transported past the detector subsystem 22 by means set forth in co-pending application Ser. no. 430,083. Thus, in the course of examining a single item of fruit, substantially all portions of the surface are illuminated uniformly, and accurate detector signals representative of different surface portions are obtained.

As seen in FIG. 2B, the detector subsystem 22 includes both a sensor portion 23 and a lens portion 25.

Figure 3:
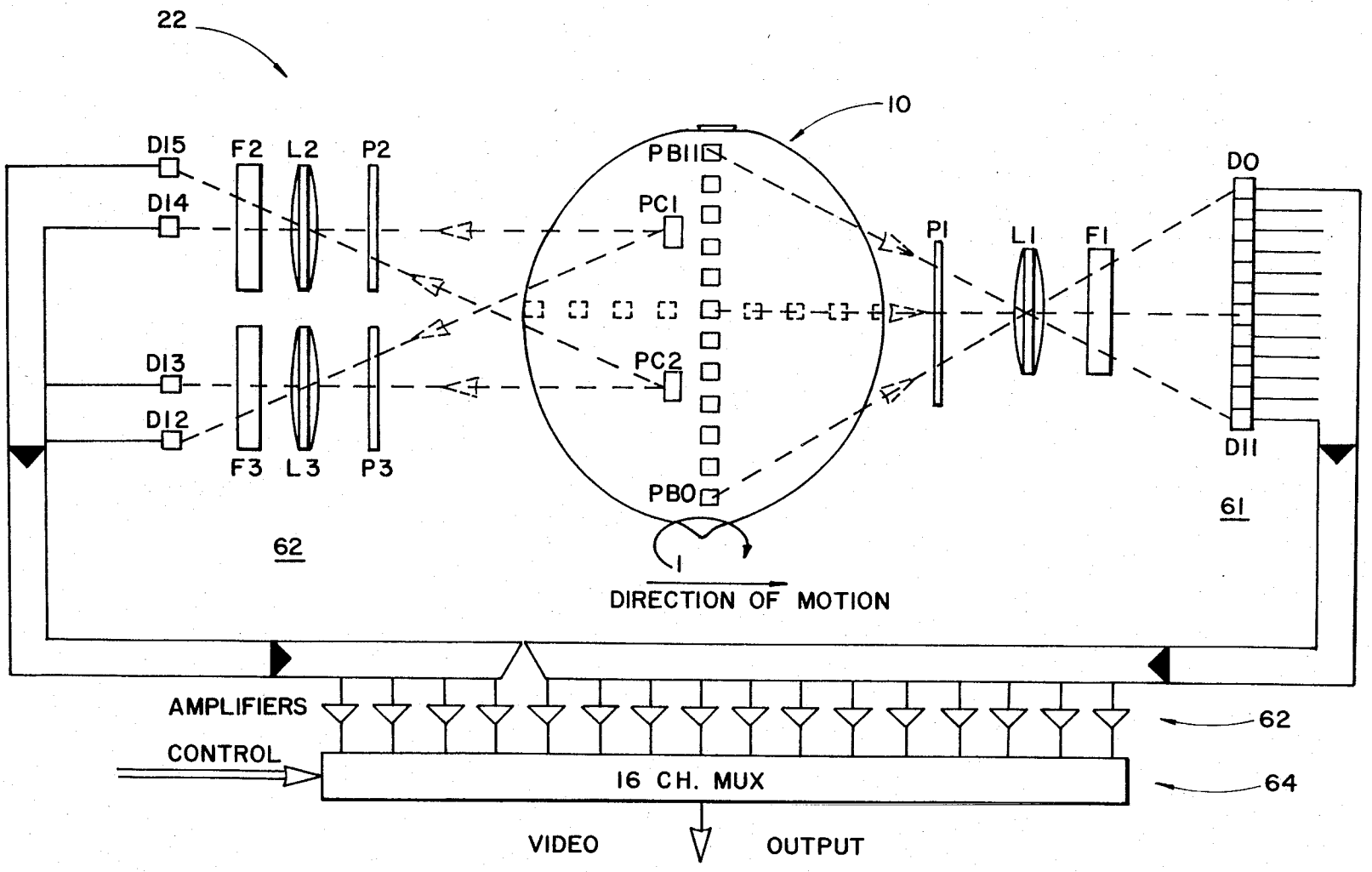
FIG. 3 is a schematic view of the detector subsystem.

Referring now to FIG. 3, there is shown a diagramatic illustration of the detector subsystem 22. The components of the subsystem 22 are diagramatically represented in relation to a passing fruit, illustrated as a lemon 10. The direction of motion and the direction of rotation of the lemon 10 are indicated. In accordance with the preferred embodiment the detector subsystem 22 comprises line scanning diode array 61, illustrated as comprising twelve separate diodes D0–D11. The linear array 61 is utilized for obtaining a linear view of the fruit for purposes of looking for blemishes. As will be more fully described below, the detector subsystem 22 may also include color detector 62 comprising diodes D12–D15 for purposes of determining color of the sorted items. The diodes D0–D11 are arranged in a line, and thus respective diodes detect reflected light from portions PB0 through PB11, illustrated as lying on a lengthwise-oriented line on the fruit item 10. Such a diode array can be obtained commercially, as the Hamamatsu S994-18 diode array. Other diode array systems are commercially available, and a vidicon or TV camera may likewise be used within the scope of this invention. The like from illuminators 20 is reflected from the portions PB0–PB11 of the surface of the item 10 through linear polorizer P1, lens L1 and filter F1 to the twelve diodes of array 61. The signals generated at diodes D0–D11 are periodically scanned and transmitted through separate amplifiers 62 to a multiplexer 64. The output of multiplexer 64 is a chopped video signal, in analog form, which is subsequently converted to digital signals at A/D converter 36 as discussed in connection with FIGS. 5 and 6 below.

The scanning speed for operation of line scanning diode array 61 is a matter of design choice, but in the preferred embodiment the array 61 is scanned at a speed to provide about 100 scans during an inspection or examination of the passing fruit. Since the fruit is moving while being rotated, for each scan each separate diode develops a signal corresponding to a new or different portion of the fruit surface. By arranging the line scanning diode array 61 such that the portions PB0–PB11 of the surface of the item 10 (or any greater number of portions) embrace substantially the length of the item, during the course of one complete rotation of the fruit separate discrete signals are generated corresponding to substantially the entire surface of the fruit item 10. In this way, the line scanning diode array 61 inspects substantially the entire surface for indications of blemish. It is to be noted that by making the line scanning diode array 61 sufficiently long such that the scanning line PB0–PB11 is longer than the fruit item 10, information is acquired to determine the length of the fruit. Further, by reading the maximum number of individual detector signals which reflect presence of the fruit throughout the approximately 100 scans while the fruit is passing, information is obtained to determine the width of the fruit. Thus, with information for determining both length and width, additional determinations for fruit volume and shape can be made, as discussed hereinbelow.

As further seen in FIG. 3, and as mentioned above, the detector subsystem 22 also includes color detector 62 which comprises diodes D12, D13, D14, and D15. Color detector 62 is utilized for generating color signals of the fruit being examined. Diodes D12 and D13 are associated with lens L3, filter F3 and linear polarizer P3, and diodes D14 and D15 are associated with lens L2, filter F2, and linear polarizer P2. The filters F2 and F3 are bandpass filters at different wavelengths corresponding to different colors, for example red and green. By this arrangement, diodes D12 and D14 generate signals representative of the amount of green color and red color at portion PC1 on the fruit, while diodes D13 and D15 generate signals corresponding to the amount of green color and red color respectively at portion PC2 of the fruit item 10. The signals from diodes D12–D15 are also amplified at 62 and multiplexed at 64. Thus, the output of multiplexer 64 is a 16 channel multiplex video signal, representing a series of 16 video levels corresponding to the outputs of the 16 diodes, D0–D15 for each scan of the detector subsystem 22. If 100 scans are taken during the examination of a single item, then the total multiplexed video output is 100 scan lengths, each scan comprising 16 separate video signals. Each video signal is digitized into an 8 bit digital byte of data, forming a block of 1600 bytes of digital data corresponding to the item examined.

Figure 4:
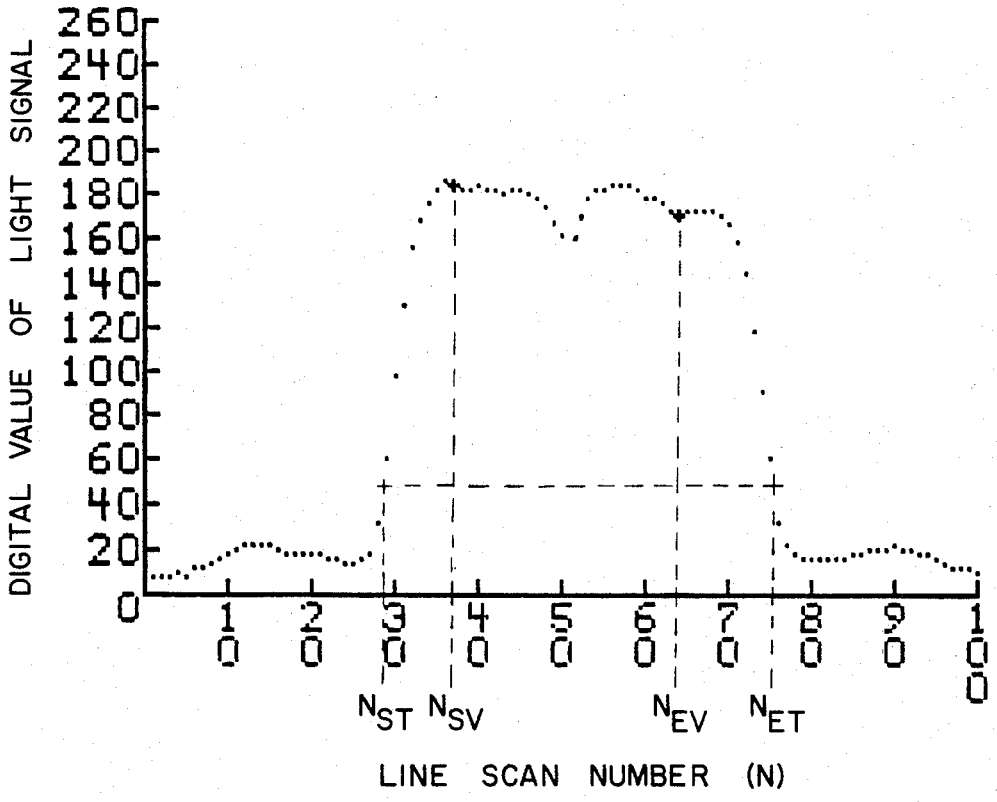
FIG. 4 is a plot of the digital output of the detector subsystem.

Referring now to FIG. 4, there is shown a representation of data which illustrates the form of the digital data retrieved from the detector subsystem 22. FIG. 4 shows data received from a single detector (D0–D15) corresponding to examination of a fruit that has been passed by the detector subsystem 22 while being rotated. The Y axis of FIG. 4 charts the level intensity of the video signal, 255 corresponding to the highest level of an 8 bit byte. The X axis of FIG. 4 carries the scan number N, corresponding to the number of times the detector subsystem 22 is scanned. As illustrated, 100 scans are shown, although the number of scans utilized for each passing fruit is a matter of design choice. If a perfect blemish-free fruit is assumed, the data signals would be substantially zero until the leading edge of the fruit intercepted the diode, and would again return to substantially zero after the trailing edge of the fruit had passed the particular diode. For the scans during which fruit is seen, the curve would have a rising edge, would be flat in the middle and would have a falling edge. In actuality the curve appears more as shown in FIG. 4. As illustrated there is a blemish centered approximately around scan line 50. Start threshold $N_{ST}$ is defined as the first scan for a given diode of detector subsystem 22 at which the signal value of the Y axis exceeds a threshold value, e.g., 50. The threshold is chosen at a level to eliminate noise and ensure only signals reflecting the fruit being processed. For the illustration of FIG. 4, $N_{ST}=28$. The end threshold value, $N_{ET}$, is defined as the last scan line above the threshold, which for this example of FIG. 4 is 74. Within the range defined by the start threshold $N_{ST}$ and end threshold $N_{ET}$, the apparatus of the present invention determines the fruit is present. Also, within this range start and end values $N_{SV}$ and $N_{EV}$ may be defined. The "start value" $N_{SV}$, is defined as the first scan signal reflecting a decreased signal level compared to the prior signal level, and for the example shown in FIG. 4, $N_{SV}$ equals 36. The "end value" $N_{EV}$ is defined as the first signal level, looking at the curve from the right, reflecting a decreased signal level compared to the next later scan signal. For the curve illustrated, $N_{EV}=64$.

As will be more apparent below the batch processing technique of the present invention permits the calculation of start values $N_{SV}$ and end values $N_{EV}$. The calculation of these values permits the apparatus of the present invention to determine blemish by comparing signal values with the unblemished surface of the particular fruit being examined. Such a technique is an advantage over a method in which signal level is compared with a level determined by a preconceived notion of what the surface of the unblemished fruit should be.

Figure 5:
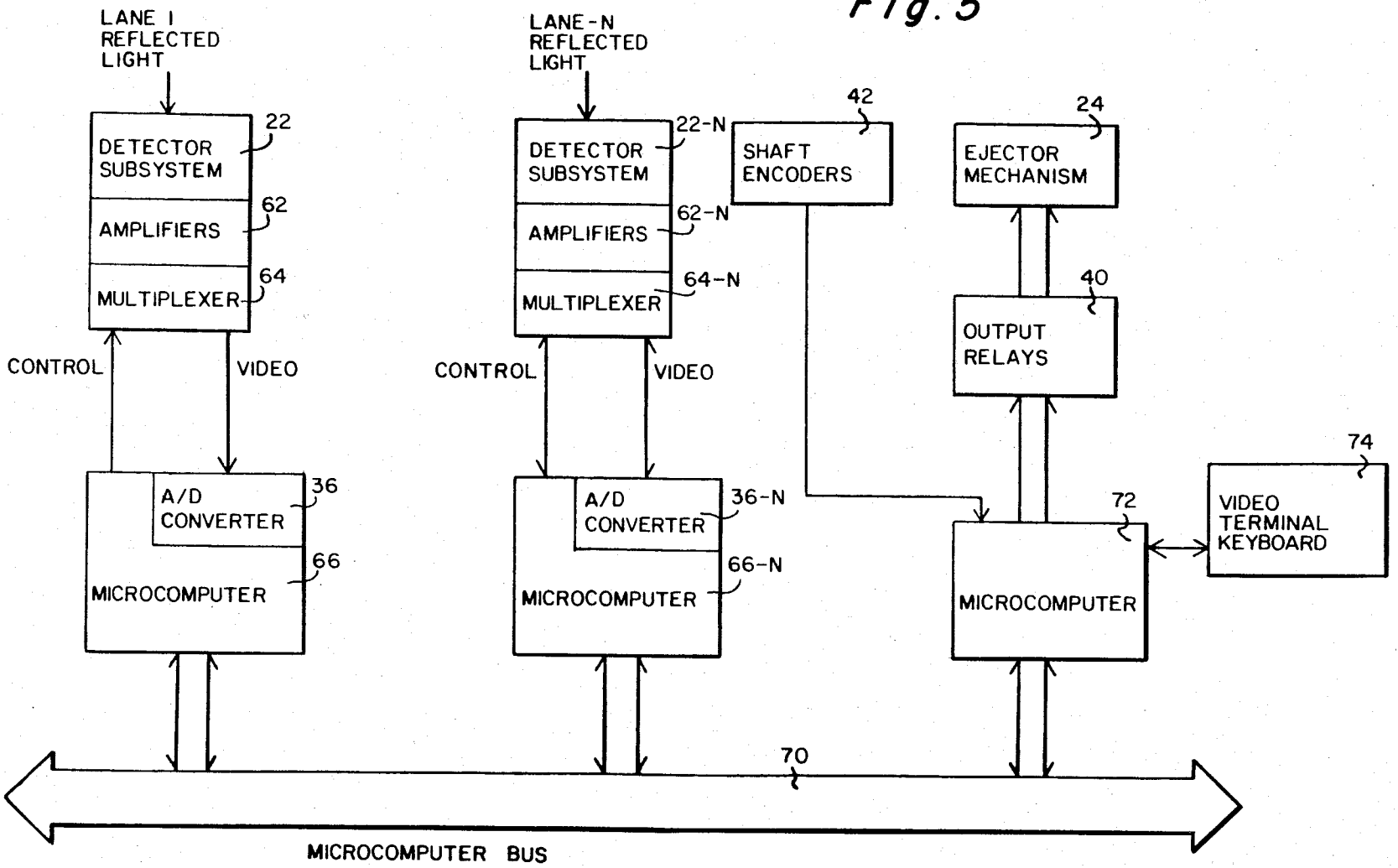
FIG. 5 is a schematic of the electronic components of the present invention.

Referring now to FIG. 5, there is shown a block diagram of the primary electronic components utilized in the apparatus of this invention for processing data, with an indication of data flow between these components. As illustrated, for each lane there is a detector subsystem 22 previously described, which includes both the blemish detectors 61 and the color detectors 62. The outputs from detector subsystem 22 are amplified as indicated at amplifiers 62 and multiplexed at block 64. The output of each multiplexer 64 is converted in A/D converters 36, resulting in a block of 8 bit bytes corresponding to each examined item. These bytes are stored in memory associated with microcomputer 66, preferably a part of a special purpose video processor card. As illustrated, the combination of elements 22, 62, 64, 36 and 66 is provided for each of the n lanes or conveyors 12. Each of the n microcomputers 66 is data linked with a master processor microcomputer 72 through bus 70, in a conventional manner. It should also be appreciated that while each of the microcomputers 66 and 72 may be a separate entity, they may also be subsystems of a single digital computer 38 referred to in connection with FIG. 1 above. In any event microcomputer 72 performs analysis and processing computations not provided for in microcomputers 66. Microcomputer 72 communicates with a video terminal and keyboard 74, for providing visual outputs to the operator and for receiving inputs. Signals from shaft encoders, as illustrated in block 42, are input to microcomputer 72, to provide basic timing control, as discussed in more detail in connection with FIGS. 6A and 6B below. Final processing, or sorting signals computed in microcomputer 72 are output to relays 40, which in turn drive ejector mechanism 24 for effectuating the desired sorting of the fruit in accordance with the chosen variables, e.g. blemish, color, volume, and shape.

Figure 6A:
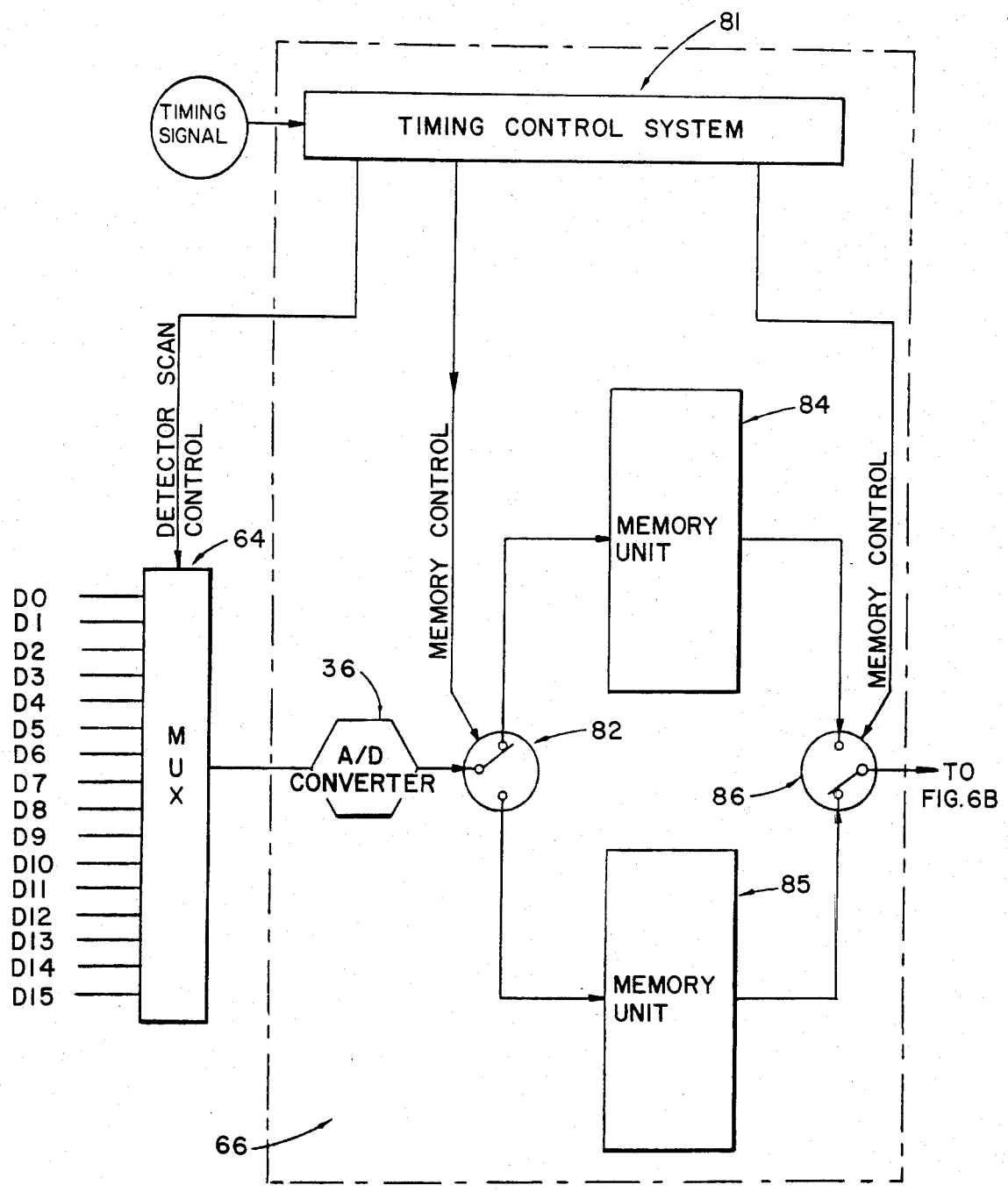
FIG. 6A is a schematic of a portion of one of the microcomputers (66) of FIG. 5.
Figure 6B:
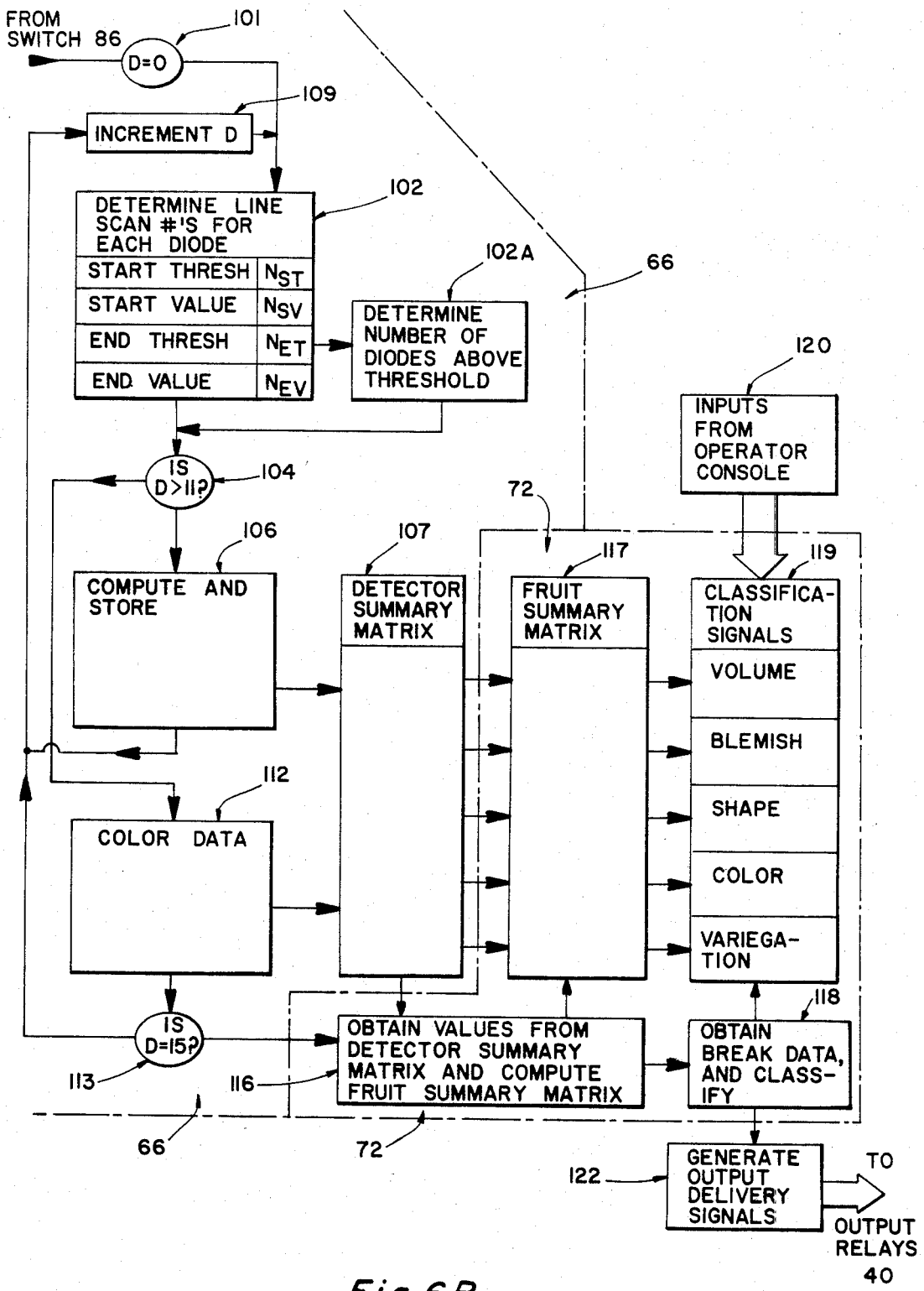
FIG. 6B is a schematic of the remaining portion of one of the microcomputers (66) as well as of another microcomputer (72) of FIG. 5.

Referring now to FIGS. 6A and 6B, there is shown a flow diagram representing the primary functions that are carried out by microcomputers 66 and 72, in order to perform the sorting functions of the apparatus and method of this invention.

Referring now to FIG. 6A, there is shown a block diagram of the portion of a single microcomputer 66 illustrating how this apparatus stores and reads blocks of data from detector subsystem 22. The multiplexer 64 is controlled by timing control system 81 which, in turn, obtains its timing signals from microcomputer 72. Microcomputer 72 obtains basic timing pulses from the shaft encoders 42. As previously discussed, A/D converter 36 converts the video signals of the detector subsystem 22. Sixteen such 8 bit bytes constitutes one linear scan of the item being examined since D, the number of diodes (D0–D15) is equal to sixteen. One hundred such scans constitutes a block of data representing a single item that has been examined, which block is input alternately to memory unit 84 and memory unit 85. The memory units 84 and 85 used for storing the blocks of data may be either allocated sections of a RAM memory or other type of memory, or may be physically separate storage units. The switching of the data blocks to either memory unit 84 or alternatively memory unit 85 for a given microcomputer 66 is shown diagramatically at switch 82. Switch 82 is under control of a memory control signal from block 81 which controls the transfer of data to one of the two memory units 84, 85 after a complete block, corresponding to an examined item, has been input to the other. A complementary memory control signal operates, as shown at switch 86, to enable output of data from either memory unit 84 or memory unit 85. Thus, while data is physically being read from a first item, such as a lemon, the digitized data signals are placed into a first storage space, or memory unit as indicated at 84. At the same time, data in the second stoage space or memory unit 85, which was collected from the prior examined item, is output at 86 for further processing. Thus, each storage unit 84, 85 is alternately read while the other is filled, such that each block of data may be analyzed on a batch basis simultaneously with generation and storage of data for the fruit then being examined at the scanning subsystem 22. As indicated in FIG. 6A, each memory unit 84, 85 contains NxD bytes, representing N Bytes for each diode, (where N is the number of scans of the diode array, in this case 100) and D is the number of diodes (in this case twelve).

Referring now to FIG. 6B, there is shown a block diagram of the remainder of the processing operations that are carried out by microcomputer 66 as well as the operations carried out by microcomputer 72 in the practice of this invention. It is to be understood that this block diagram does not include all steps taken by the software, such as various bookkeeping, zeroing and calibration steps, but sets forth the primary process steps utilized in the invention as claimed. In the preferred embodiment an Intel 8088 Type microprocessor unit is employed for each of the microcomputers 66 and 72, but it is to be understood that other microprocessor or computer embodiments, of equivalents of greater capacity may be utilized. Likewise, the operations illustrated may be performed with equivalent electronic hardware.

The output from switch 86 is input at the top left of the flow diagram shown in FIG. 6B. At 101, a counter keeping track of the particular diode of detector subsystem 22 is set to zero, corresponding to the first diode D0 in the line scanning diode array 61. At block 102, the software determines, for each diode, the start threshold ($N_{ST}$), start value ($N_{SV}$), end threshold ($N_{ET}$) and end value ($N_{EV}$). Reference is made to FIG. 4, which illustrates these previously defined scan numbers. As can be seen, it is necessary to perform a batch operation on all of the data for a given diode, in order to determine, for example, $N_{EV}$. This is an operation that cannot readily be performed serially, as the data is being collected. The threshold values, $N_{ST}$ and $N_{ET}$, are calculated by comparing each data signal, corresponding to a portion PB on the fruit, with a predetermined threshold level, e.g., 50. Data outside the thresholds is not utilized for blemish analysis. All data, however, between thresholds $N_{ST}$ and $N_{ET}$ is utilized, even though there may be data signals within that range which drop below the threshold, e.g., due to blemishes. $N_{SV}$ is obtained at a subroutine of block 102 by comparing each discrete byte, or data signal for a given diode of line scanning detector array 61 following the start threshold $N_{ST}$ with the prior data signal, and determining if there has been a decrease in value. $N_{EV}$ is also determined by a subroutine of block 102 which inspects the data signals, or bytes going backwards from $N_{ET}$, i.e. each prior signal is successively examined to see when its value decreases to a level less than the value of the immediately succeeding data signal.

After software has performed the operations of block 102 corresponding to a given diode of line scanning diode array 61, a check is made at block 104 to determine if D is greater than 11, i.e., whether all twelve of the blemish scan diodes D0–D11 have been analyzed. Assuming D is not greater than 11, the software next performs the steps indicated at block 106 entitled "Compute and Store". For the diode that has just been analyzed, the difference between $N_{ET}$ and $N_{ST}$ is determined at block 106, and stored in assigned storage space designated at block 107 as "detector summary matrix". The difference between $N_{ET}$ and $N_{ST}$ gives an indication of the fruit width. Further, between the start and end values, $N_{SV}$ and $N_{EV}$, each data signal is compared with the next succeeding signal, and the absolute difference is generated. The absolute differences are summed throughout the range between the start and stop values at block 106, and stored in assigned space of the detector summary matrix 107. Thus, for the detector being operated on, there is obtained a summation of the absolute differences of successive pairs of signals, which differences represent contrast between adjacent surface portions of the item. The summation is thus a representation of the amount of blemish, or lack of uniform color, seen by the particular diode detector D0–D11. As alternative or additional embodiments the absolute differences may also be squared and stored or compared with a threshold and stored if the threshold is exceeded as a further indication of blemish.

In an alternative embodiment the processing is varied as shown at 102A to determine the number of diodes D0–D11 which show at least one byte above the threshold $N_{ST}$ and $N_{ET}$. This is desireable in applications where an indication of shape is obtained, as discussed above. In this application, each time a start threshold $N_{ST}$ is found, indicating that the detector has seen the fruit, a counter, initially set to zero, is indexed by one. In the course of looping through the operations 102, 102A for each diode in the array, of diodes that have seen fruit, there is developed a count of the number which in turn is an indication of the length of fruit in the direction of the diode array 61. Of course, as pointed out before, this requires that the diode array 61 by extended to a length greater than the anticipated fruit length. Additionally, at block 106, the maximum figure of $N_{ET}$ and $N_{ST}$ is determined, which represents the maximum width of the item. Both the fruit width and the fruit length figures are stored in detector summary matrix 107.

After the difference summation of block 106 operation has been performed at block 106, the program loops back to block 109, where D is incremented so that the next diode of line scanning diode array 61 are examined. When D becomes greater than 11, which is determined at block 104, blemish data acquisition is completed and the program branches to perform given color operations at color data block 112. In these operations, at block 112, the following color data calculations are made.

(1) Maximum value, within the range $N_{SV}$ to $N_{EV}$ of the ratio of the outputs of diode D12 to D14 and the same for D13 to D15.

(2) Minimum values, same factors as in (1) above.

(3) Avg. of the ratio of the outputs of diodes D12 to D14 within the range $N_{SV}$ to $N_{EV}$ and the same for color diodes D13 to D15.

(4) (Max (1)−Min (2))/(Max+Min), for each diode pair D12 and D14, and D13 and D15.

The above calculated values are stored in the detector summary matrix 107. After all the color calculations have been made at block 112 as is determined at block 113, the software branches at 116 to use the values in the detector summary matrix 107 to compute a fruit summary matrix shown at block 117. The computed values are stored in allocated memory space (indicated at block 117) of microcomputer 72.

The following operations are performed at block 116, with the resulting determined values stored in fruit summary matrix 117:

(1) The difference values $N_{ET}-N_{ST}$ stored in detector summary matrix 107 are squared and summed, the resulting summation being a representation of fruit volume. For blemish diodes, D0–D11 this figure represents the square of twelve threshold differences, each such difference representing the width of the fruit as seen by the respective detector.

(2) The sums of the absolute differences for blemish diodes D0–D11 are examined, and the largest one is taken and stored as an indication of blemish. In the alternative, any given fraction of the diode sums is accumulated to obtain the blemish figure. As a further alternative the average of the absolute differences may be determined and stored to obtain a blemish figure.

(3) A shape signal, representing length divided by width, is calculated and stored.

(4) The maximum color ratio (D12/D14 or D13/D15) is selected and stored. This gives an indication of the greatest ripeness portion detected.

(5) The smallest color ratio, representing the greenest or least ripe sensed portion, is selected and stored.

(6) The average of the color ratios is computed and stored, giving a representation of the average detected color of the fruit.

(7) The largest of the two variegation ratios is selected and stored, representing largest measure of contrast between ripeness and greenness found in the color examination.

After performance of the operations indicated in block 116, the software compares the values stored in the fruit summary matrix 117 with predetermined break data. As indicated at block 120, break inputs can be entered through the operator console at video terminal keyboard 74 in conventional fashion. The break inputs represent levels according to which it is desired to sort for each of the variables being used for sorting. As is known in the art, if it is desired to sort in accordance with N grades of classification, N−1 break values must be supplied against which the fruit signal is compared. Such classification comparisons are done as indicated at block 119, for volume, blemish, shape, color, variegation, or any combination thereof. Following such classification, output delivery signals are generated as indicated in block 122, and connected to output relays 40 in conventional fashion. Reference is made to U.S. Pat. No. 4,106,628, which illustrates the generation of classifying or sorting signals by comparing the processed data signals with break values, and generating therefrom signals for proper sorting of fruit at a downstream location.

While a particular embodiment of the present invention has been shown and described, it will be appreciated that various modifications may be effected without departing from the spirit and scope thereof.

Accordingly, what is claimed is:

1. Apparatus for processing items such as fruit and the like; comprising:

video signal means for examining an item and developing a plurality of discrete data signals, each said data signal being representative of a condition of a respective portion of said item;

storage means for storing said data signals as they are generated, thereby generating a stored batch of item data corresponding to said item;

batch processing means for processing said batch of data to generate one or more batch reference signals representative of the batch of item data, and process signal generation means for generating at least one process signal by processing at least some of the data of said batch as a function of said one or more batch reference signals; and means for processing said item as a function of said one or more process signals.

2. The apparatus as described in claim 1, wherein said video signal means comprises a plurality of detectors positioned to examine different portions of said item, and wherein each said detector generates a said batch of data, all of the batches of data corresponding to a given item forming a block of data, said storage means storing said block of data; and said batch processing means processes each batch of said block in generating said batch reference signals.

3. The apparatus in claim 2, further comprising:

means for transporting successive items past said video signal means;

said storage means comprising at least two operably distinct storage units; and data control means for controlling transfer of data signals being generated by said video signal means and corresponding to a particular item to a respective one of said storage units, and for concurrently controlling said batch processing means to analyze a prior block of data signals corresponding to a prior item which was stored in a respective other one of said storage units while the signals of said prior block were being generated.

4. The apparatus as described in claim 3, comprising:

two of said storage units, and wherein said data control means controls transfer of data being generated by said video signal means into one of said storage units while said batch processing means operates on the block of data stored in the other of said storage units, and for alternating the above two operations each time the video signal means examines a next successive item.

5. The apparatus as described in claim 2, comprising:

means for moving said item relative to said video signal means, and wherein said video signal means comprises an amplifier corresponding to each of said detectors, multiplexer means for scanning said detectors over a plurality of scans, and an analog to digital converter for converting signals from said detectors and data control means for controlling the scanning of said detectors by said multiplexer, whereby a block of digital bytes is generated corresponding to each examined item.

6. The apparatus as described in claim 5, wherein said data control means controls the scanning of said plurality of detectors a predetermined plurality of times corresponding to each item examined, and controls the transfer of data to said storage means such that said block of data comprises a matrix of NxD bytes of data, N representing the number of scans of said plurality of detectors and D representing the number of detectors in said plurality of detectors.

7. The apparatus as described in claim 6, wherein said batch processing means comprises:

means for inspecting data from each of said N scans to determine start and stop threshold values for each detector and for generating said process signals as a function only of data encompassed by said threshold values.

8. The apparatus described in claim 7, wherein said batch processing means further comprises:

means for obtaining the square of the difference between the stop threshold value and the start threshold value corresponding to each detector, and for summing such difference square values to get a volume signal for each said item, said processing means having means for sorting said items as a function of volume.

9. The apparatus as described in claim 7, wherein said batch processing means further comprises:

means for inspecting data from each of said N scans of each detector to determine a start value and a stop value, and for generating said process signals as a function only of data encompassed by said start and stop values.

10. The apparatus as described in claim 9, wherein said batch processing means further comprises:

difference means for operating on the bytes in a stored data block corresponding to each detector and obtaining the differences of adjacent scan bytes between said start and stop values corresponding to each detector and wherein said processing means sorts said items as a function of said differences.

11. The apparatus as described in claim 10, wherein said batch processing means further comprises:

means for summing said differences and for selecting a predetermined number of said sums of differences of the different detectors, and for sorting said items as a function of said selected sums.

12. The apparatus as described in claim 2, wherein said batch processing means comprises:

means for determining, from said block of data, a representation of two orthogonal dimensions of said item, and for generating therefrom a signal representative of the shape of said item, and said means for processing comprises:

means for sorting said items as a function of shape.

13. The apparatus as described in claim 2, wherein said video signal means comprises:

a first set of said detectors employed to generate blemish signals, and a second set of said detectors employed to generate color signals, and said means for processing comprises:

means for sorting said items as a function of color and blemish.

14. The apparatus as described in claim 2, further comprising:

means for moving successive items into position to be examined by said video signal means, and wherein said batch processing means comprises:

means for generating, from each block of item data, a signal representative of item variegation, and means for sorting said items as a function of item variegation.

15. The apparatus as described in claim 2, wherein said video signal means comprises:

illuminating means for illuminating said item as it is passed by said video signal means, said illuminating means having a plurality of light sources positioned to direct overlapping light on the surface examined by said video signal means, thereby providing substantially uniform illumination of said item as it is examined.

16. The apparatus as described in claim 2, comprising:

means for moving successive items into position to be examined by said video signal means, and where said video signal means comprises:

an array of light detectors, each positioned to generate a signal representative of light reflected from a portion of the surface of said item, and uniform illuminating means for uniformly illuminating each said portion of item surface by directing substantially equal amounts of light thereon from a plurality of sources, whereby said detectors generate signals representative substantially only of the surface condition of said item.

17. the apparatus as described in claim 16, wherein said video signal means views said item at a first direction, and each of said sources is aligned to direct light at said item at an angle relative to said first direction, said angle being 45° or greater.

18. The apparatus as described in claim 2, wherein said means for processing comprises means for sorting said items as a function of blemish and volume.

19. The apparatus as described in claim 2, wherein said means for processing comprises means for sorting said items as a function of color and volume.

20. The apparatus as described in claim 2, wherein said means for processing comprises means for sorting said items as a function of blemish, color and volume.

21. The apparatus as described in claim 2, wherein said means for processing comprises means for sorting said items as a function of blemish, color, volume and variegation.

22. Apparatus for processing items such as fruit and the like said apparatus having light signal means for viewing said items and generating a plurality of data signals corresponding to each viewed item, and means for moving successive items into position to be viewed by said light signal means, characterized by:

means for illuminating each said item substantially uniformly over the surface thereof being viewed by said light signal means;

difference means for obtaining difference signals corresponding to the differences of respective said data signals corresponding to respective adjacent portions of the surface of each said item, and for generating at least one sorting signal for each said item as a function of said difference signals;

block data means for receiving all of said data signals corresponding to each given item and batch generating thereform at least one block signal, and for controlling said difference means to process the data signals of said block as a function of said block signal in generating said at least one sorting signal; and sorting means for sorting each said item as a function of said sorting signal.

23. Apparatus for processing items such as fruit and the like, comprising:

video signal means having at least one detector diode for examining an item and generating a plurality of digital signals, each said signal being representative of the surface condition of a respective portion of said item, batch processing means for accumulating said digital signals and for batch processing of said accumulated signals to generate item characteristic signals therefrom, selecting means for selecting certain of said digital signals as a function of said item characteristic signals and condition signal generating means for generating at least one condition signal from said selected digital signals, and sorting means for sorting said item as a function of said at least one condition signal.

24. The apparatus as described in claim 23, wherein said video signal means comprises illuminating means for illuminating said item when in position to be viewed, said illuminating means comprising a plurality of light sources each directing light at a portion of said item, said light sources being arranged substantially in a plane displaced from said item as it is being viewed, said video signal means comprises an array of said detector diodes, and said batch processing means accumulates and batch processes the digital signals from each of said diodes.

25. The apparatus as described in claim 24, wherein said light sources direct light towards said item at an angle relative to said plane, which angle is in a range of about 15°–45°.

26. Apparatus for sorting items such as fruit, having means for moving successive said items to and past a predetermined location and means for generating a block of item signals representative of each said item as it is about at said location, characterized by means for storing each said block of item signals as said item signals are generated and means for processing said block of signals after all of said item signals in a block have been generated;

said means for processing comprising means for first inspecting each said block of item signals and for developing therefrom one or more block characteristic signals and second means for then processing said block of signals as a function of said determined signal characteristics and for developing therefrom a sorting signal corresponding to each item; and means for sorting said items in accordance with said sorting signal.

27. The apparatus of claim 26, wherein said means for processing further comprises means for selecting less than all of the item signals of each said block as a function of said determined signal characteristics, and means for processing said selected signals from each said block to develop therefrom said sorting signal corresponding to each item.

28. A method of processing items such as fruit and the like, comprising:

examining each item with a video means and generating a block of data signals, each said signal being representative of a condition of a respective portion of said item, batch processing said block to generate an item processing signal, said batch processing including selecting certain of said data signals as a function of predetermined criteria, said selected signals being less than all of the signals of said block, and generating said item processing signal by processing said selected signals, and processing said each item as a function of said item processing signal.

29. The method as described in claim 28, comprising generating an item processing signal representative of blemish of said each item, and sorting said items as a function of said blemish signal.

30. The method as described in claim 28, comprising generating an item processing signal representative of blemish and color of each item, and sorting said items as a function of said blemish and color signal.

31. The method as described in claim 28, comprising generating an item processing signal representative of blemish and volume of each item, and sorting said items as a function of said blemish and volume signal.

32. The method as described in claim 28, comprising generating an item processing signal representative of color and volume of each item, and sorting said items as a function of said color and volume signal.

33. The method as described in claim 28, comprising generating for each said item processing signals representative of one or more of the conditions of blemish, color, volume, shape and variegation, and sorting said items as a function of said one or more processing signals.

34. A method for sorting items such as fruit, utilizing apparatus having means for moving successive items to and past a predetermined location and means for generating a block of item signals representative of each said item as it is about at said location, and means for storing each said block of item signals as said item signals are generated, characterized by first batch inspecting each said block of item signals to determine one or more block characteristics;

then processing said inspected block of signals as a function of at least one of said determined block characteristics and developing therefrom at least one sorting signal corresponding to each said item; and sorting each of said items in accordance with said at least one sorting signal.

35. The method of claim 34, wherein said batch inspecting step further comprises selecting less than all of the item signals of each said block, and said processing step comprises processing just said selected signals.

* * * * *